United States Patent [19]

Wahle et al.

[11] 4,011,966

[45] Mar. 15, 1977

[54] DISTRIBUTOR FOR CIGARETTE ROD MAKING MACHINES OR THE LIKE

[75] Inventors: Günter Wahle, Reinbek; Jürgen Gomann, Dassendorf, both of Germany

[73] Assignee: Hauni-Werke Korber & Co., KG, Hamburg, Germany

[22] Filed: Mar. 2, 1976

[21] Appl. No.: 663,119

[30] Foreign Application Priority Data

Mar. 6, 1975 Germany ..... 2509720

[52] U.S. Cl. ..... 222/55

[51] Int. Cl.[2] ..... B67D 5/14

[58] Field of Search ..... 222/55, 56

[56] References Cited

UNITED STATES PATENTS

| | | | |
|---|---|---|---|
| 2,920,355 | 1/1960 | Clark | 222/55 |
| 3,291,285 | 12/1966 | Gray et al. | 222/55 X |

*Primary Examiner*—Stanley H. Tollberg
*Assistant Examiner*—Hadd Lane
*Attorney, Agent, or Firm*—Peter K. Kontler; John Kurucz

[57] ABSTRACT

The distributor of a cigarette rod making machine has an upright duct the upper end of which receives particles of tobacco from a magazine and the lower end of which has an outlet of variable cross-sectional area. The outlet is adjacent to the carding of a drum which withdraws from the duct a continuous layer of particles, and such particles travel toward a transversely extending barrier which is reciprocated in parallelism with the axis of the drum. The barrier has a grooved first surface which engages the exposed side of and homogenizes the layer, and a second surface which faces counter to the direction of movement of the drum and intercepts the surplus of particles whereby the intercepted particles pile up in front of the barrier. The pressure of piled-up particles is monitored by a sensor which causes a mechanical adjusting device to change the cross-sectional area of the outlet so that the area decreases when the pressure of piled-up particles increases, and vice versa.

10 Claims, 1 Drawing Figure

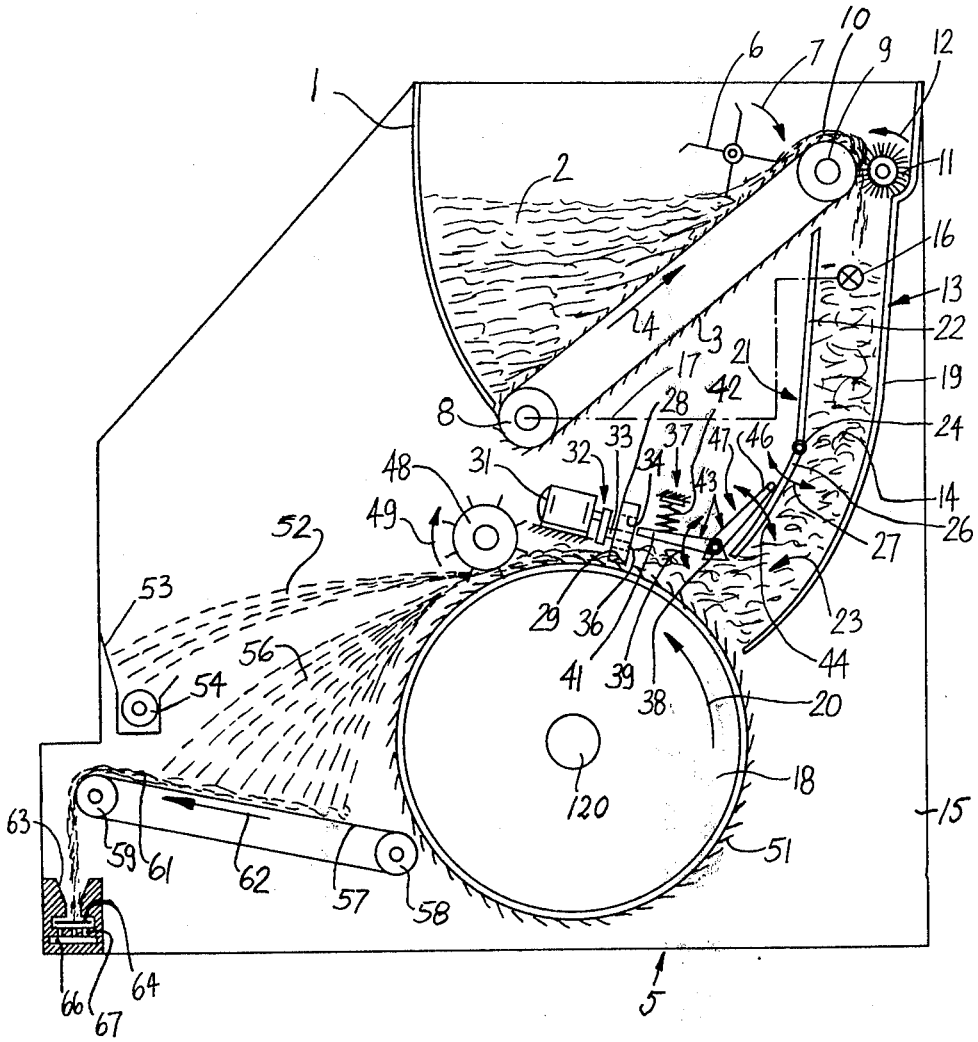
1
2
3
4
5
6
7
8
9
10
11
12
13
14
15
16
17
18
19
20
21
22
23
24
26
27
28
29
31
32
33
34
36
37
38
39
41
42
43
44
46
47
48
49
51
52
53
54
56
57
58
59
61
62
63
64
66
67
120

DISTRIBUTOR FOR CIGARETTE ROD MAKING MACHINES OR THE LIKE

CROSS-REFERENCE TO RELATED INVENTIONS

The distributor of the present invention constitutes an improvement over and a further development of apparatus which are disclosed in the commonly owned copending applications Ser. Nos. 536,302 (filed Dec. 24, 1974) and 569,180 (filed Apr. 17, 1975) of Alfred Hinzmann.

BACKGROUND OF THE INVENTION

The present invention relates to apparatus for producing and processing a homogenized layer of fibrous particles, particularly to improvements in distributors for use in cigarette rod making machines or the like. Still more particularly, the invention relates to improvements in treatment of shredded tobacco or analogous fibrous material prior to and during conversion of a supply (e.g., a column) of such material into a continuous layer, e.g., into a layer adapted to be converted into a narrow tabacco stream which is ready to be trimmed (if necessary) and draped into a web of cigarette paper or the like to form therewith a continuous rod wherein a tubular wrapper surrounds a rod-like tobacco filler.

Satisfactory homogenization of a layer of natural or reconstituted tabacco particles which are to form the filler of a continuous cigarette rod is highly desirable for a number of reasons. Thus, uniform distribution of shorter and longer tobacco shreds in the filler of a cigarette rod contributes to uniformity of the weight of discrete cigarettes and reduces the likelihood of escape of tobacco particles at the tobacco-containing ends of a plain cigarette or at the tobacco-containing end of a filter cigarette. As a rule, the weight of cigarettes and other rod-shaped smokers' products must match, or is permitted to deviate only negligibly from, a predetermined norm. Also, the tobacco-containing ends of cigarettes are tested prior to packing, and the cigarettes having unsatisfactory tobacco containing ends are segregated from acceptable cigarettes so that absence of homogenization of the layer which is converted into a rod-like filler invariably results in an excessive number of rejects. The distributor of a cigarette rod making machine normally comprises a conveyor which withdraws an unequalized layer of tobacco particles from a relatively large supply or mass of such particles, and the layer is thereupon transported past several stations which include brushes, rollers, drums, endless belt conveyors and like equalizing and homogenizing components which uniformize the layer prior to admission of its particles into the tabacco stream forming zone, e.g., into an elongated channel wherein a shower of tabacco particles is converted into a narrow stream. The aforementioned homogenizing components invariably produce a relatively high percentage of short tobacco and tobacco dust which is likely to be segregated from longer particles to form unsatisfactory sections of the stream.

German printed publication No. 1,782,380 discloses a distributor wherein a drum withdraws tobacco particles from a duct and showers the withdrawn particles onto an endless band conveyor. The distributor further includes means for weighing the quantity of showered tobacco particles per unit of time and for transmitting signals which are utilized to regulate the speed of the drum for the purpose of maintaining the weight of withdrawn particles within a predetermined range. Such distributors constitute an improvement over other conventional distributors; however, their cost is rather high, especially in view of relatively small improvements in the quality of the filler.

SUMMARY OF THE INVENTION

An object of the invention is to provide an apparatus which can homogenize a layer of tobacco shreds or analogous fibrous particles in a simple and inexpensive way, which occupies little room, and whose homogenizing action is superior to that of heretofore known apparatus.

Another object of the invention is to provide a distributor for natural and/or reconstituted tobacco which is capable of producing a tobacco layer whose composition, density and dimensions (especially thickness) are more satisfactory than those of tobacco layers which are produced in conventional distributors.

A further object of the invention is to provide a distributor for tobacco shreds with novel and improved means for insuring highly satisfactory withdrawal of fibrous particles from a relatively large supply of particles, especially as concerns the rate of withdrawal, the quantity of short tobacco particles and tobacco dust which develops during withdrawal, and the predictability of distribution of longer and shorter particles and tobacco dust throughout the layer.

The invention is embodied in an apparatus for producing and processing a homogenized layer of fibrous particles, particularly in a distributor for shredded tobacco. The apparatus comprises a source of fibrous particles (e.g., an upright duct) which has an outlet (preferably at its lower end) of variable cross-sectional area, a rotary drum or an analogous conveyor having means (e.g., a carding) for removing from the outlet a continuous layer of fibrous particles and for advancing the layer in a predetermined direction and along a predetermined path wherein the layer has an exposed side, a preferably elongated strip-shaped barrier adjacent to the path of movement of the layer and having a first surface which is in contact with the exposed side of the layer and a second surface which is adjacent the first surface and extends transversely of the path of the layer and faces counter to the direction of movement of the layer so that at least some fibrous particles of the layer are intercepted by and pile up at the second surface of the barrier, a motor or analogous means for moving the barrier substantially transversely of the path whereby the first surface of the barrier (this first surface is preferably formed with raised and recessed portions, e.g., with ribs and grooves extending in the direction of movement of the layer) homogenizes that portion of the layer with is moved beyond the second surface of the barrier, a spring-biased bell crank lever or other suitable sensor means for monitoring the quantity of piled-up particles at the second surface of the barrier, and adjusting means which is operatively connected with the sensor means and serves to vary the cross-sectional area of the outlet of the source in response to variations in the quantity of piled-up particles at the second surface so that the cross-sectional area of the outlet is reduced when the quantity of piled-up particles (and hence their pressure upon the sensor means) increases, or vice versa.

The inlet of the aforementioned source can receive fibrous particles from a suitable magazine, e.g., through the medium of a carded belt conveyor which draws particles from the magazine and a picker roller which propels the thus withdrawn particles into the inlet of the source. The aforementioned drum preferably rotates about a horizontal axis and the outlet of the source is preferably located at a level below the inlet. It is presently preferred to mount the sensor means and the barrier at a level above the axis of rotation of the drum.

The novel features which are considered as characteristic of the invention are set forth in particular in the appended claims. The improved distributor itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE is a vertical sectional view of a distributor which forms part of a cigarette rod making machine and embodies one form of the invention.

DESCRIPTION OF THE PREFERRED EMBODIMENTS

The distributor which is shown in the drawing is mounted in the frame or housing 5 of a cigarette rod making machine, e.g., a GARANT (trademark) which is manufactured by Hauni-Werke Korber & Co. KG, of Hamburg-Bergedorf, Federal Republic Germany. A magazine 1 of the distributor contains a large supply of comminuted tobacco 2 which is a mixture of heavier tobacco particles 52 (e.g., ribs, stem and birds' eyes) and lighter tobacco particles 56 (mainly shreds of tabacco leaf laminae). The supply of tobacco 2 in the magazine 1 is replenished continuously or at regular or irregular intervals. The bottom wall of the magazine 1 constitutes the upwardly inclined upper stretch or reach of an endless carded belt conveyor 3 which is trained over rollers 8, 9 and is driven by roller 8 to move in the direction indicated by arrow 4. The upper reach of the conveyor 3 cooperates with a refuser, here shown as a paddle wheel 6, which is driven to rotate in the direction indicated by arrow 7 and has preferably elastic paddles or blades which brush back the surplus of tobacco particles 2 so that the upper reach of the conveyor 3 withdraws from the magazine 1 a relatively thick and wide carpet 10 consisting of randomly intermingled lighter and heavier particles 56 and 52. The carpet 10 travels around the upper roller 9 and is expelled from the carding of the conveyor 3 by a rapidly rotating picker roller 11. The arrow 12 indicates the direction of rotation of the roller 11.

The blades of the paddle wheel 6 perform a coarse equalizing action so that, as long as the roller 8 drives the conveyor 3 at a constant speed, the picker roller 11 showers identical or nearly identical quantities of tobacco particles 2 per unit of time. The pins of the picker roller 11 propel the particles of the carpet 10 into the open upper end or inlet of a source here shown as an upright duct 13 which serves to accumulate and maintain an intermediate supply or column 14 of randomly intermixed heavier and lighter tobacco particles 52 and 56. In the illustrated embodiment, the duct 13 is slightly inclined in a downward direction and to the left, as viewed in the drawing.

It is desirable to insure that the quantity of tobacco particles which form the intermediate supply or column 14 should fluctuate very little or not at all. To this end, the height of the column 14 is monitored by an upper level detector 16, e.g., a photoelectric cell which is operatively connected with the drive means for the roller 8 to effect an acceleration of this roller (and of the belt conveyor 3) when the height of the column 14 decreases below a first predetermined level and to decelerate the roller 8 and conveyor 3 when such height rises to or above a second predetermined level. The manner in which the signals which are transmitted by the photosensitive transducer of the cell 16 can influence the drive means for the roller 8 and conveyor 3 is conventional and, therefore, the details of the operative connection 17 (indicated by a phantom line) between the transducer of the cell 16 and the drive means for the roller 8 are not shown in the drawing.

The width of the duct 13 (as considered at right angles to the plane of the drawing) equals or approximates the axial length of a second endless conveyor here shown as a carded drum 18 which is driven by a horizontal shaft 120 so that the speed of its carding 51 is synchronized with the speed of movement of several other moving parts of the cigarette rod making machine. The duct 13 extends between the two platens 15 (only one shown) of the housing 5 and further includes a fixed rear wall 19 and a composite front wall 21. The front wall 21 of the duct 13 includes a stationary first or upper portion 22 which extends close to the lower reach of the carded belt conveyor 3 and a mobile (preferably pivotable) second or lower portion or flap 26 which is adjacent to the front side of the outlet 23 of the duct 13. This outlet is adjacent to the carding 51 of the drum 18. The upper end of the flap 26 is pivotable about the fixed axis of a horizontal pintle 24 and the lower end of this flap is spaced apart from the periphery of the drum 18 so as to provide room for withdrawal of a layer of tobacco particles 2 from the outlet 23 of the duct 13. The directions in which the flap 26 is pivotable about the axis of the pintle 24 are indicated by a double-headed arrow 27. When the flap 26 is pivoted in a counterclockwise direction, as viewed in the drawing, it reduces the cross-sectional area of the outlet 23 and compacts the mass of tobacco particles 2 in the outlet 23. In fact, the flap 26 can interrupt the movement of the tobacco column 14 toward the carding 51 of the drum 18. When the flap 26 is held against pivotal movement, the density of the lower portion of the column 14 is substantially constant because the photoelectric cell 16 cooperates with the roller 8 and conveyor 3 to insure that the height of the column in the duct 13 remains within a predetermined (and preferably narrow) range.

The drum 18 is driven to rotate in the direction indicated by arrow 20, and its carding 51 draws an unequalized layer of tobacco particles 2 from the outlet 23 of the duct 13 toward an elongated strip-shaped barrier 28 which reciprocates in a direction at right angles to the plane of the drawing (i.e., in parallelism with the axis of the shaft 120) and is preferably mounted at or slightly upstream of the apex of the drum 18. The length of the barrier 28 equals or approximates the width of the carding 51 and its end portions are movably mounted in suitable bearings (not shown) provided therefor in the respective platens 15 of the housing 5. The underside or first surface 29 of the barrier 28 (i.e., that surface which faces the periphery of the drum 18) is preferably profiled (e.g., grooved) in a manner and for the purposes as shown and disclosed in the commonly owned copending application Ser. No. 536,302 of Alfred Hinzmann, filed Dec. 24, 1974. The purpose of the barrier 28 is to intercept the surplus of tobacco particles 2 which are removed by the carding 51 as well as to homogenize the remaining portion of the layer by reducing the hills and valleys at the exposed upper side of the layer which moves between the surface 29 and the periphery of the drum 18. The means for reciprocating or oscillating the barrier 28 at right angles to the plane of the drawing comprises a prime mover 31 (e.g., an electric motor) whose output shaft drives a crank arm 32 having a crank pin 33 which extends into an elongated vertical slot 34 machined into an intermediate portion of the barrier. The barrier 28 further comprises a substantially vertical second surface 36 which extends upwardly from the right-hand end of the surface 29 and serves as a means for intercepting the surplus of tobacco particles 2 whereby such surplus piles up in front of the barrier 28 and bears against the underside of a plate-like member 41 forming part of a sensor 37. The surface 36 of the barrier 28 extends transversely of the path of the layer which is withdrawn by the carding 51 and faces counter to the direction of movement of such layer. The sensor 37 is responsive to the pressure of tobacco particles 2 which pile up in front of the barrier 28 and is biased by a helical spring 42 which reacts against a fixed retainer in the housing 5 and urges the member 41 downwardly, as viewed in the drawing. The member 41 constitutes one arm of a bell crank lever 43 which is fulcrumed at 38 and further includes a second arm 46 which abuts against the outer side of the flap 26. The directions in which the arms 41, 46 of the bell crank lever 43 are movable in response to pivoting of the lever 43 at 38 are respectively indicated by double-headed arrows 39 and 44. The axis of the fulcrum 38 is parallel to the axes of the shaft 120 and pintle 24. The length of the member 41, as considered at right angles to the plane of the drawing, preferably equals the length of the drum 18 and the width of the outlet 23. The parts 26 and 46 together constitute a simple adjusting mechanism which can change the cross-sectional area of the outlet 23 in dependency on the pressure which the piled-up articles 2 exert against the underside of the member 41.

The barrier 28 is followed by a picker roller 48 which is driven to rotate in the direction indicated by arrow 49. This roller expels the particles of the homogenized tobacco layer from the carding 51 of the drum 18 and propels the particles in a direction to the left, as viewed in the drawing. The flight spans of heavier particles 52 are longer and such particles are intercepted by a receptacle 53 which is mounted in the housing 5 and the bottom portion of which contains a feed screw 54 serving to evacuate the intercepted heavier particles, either at intervals or continuously. Such particles can be fed to a machine for the making of reconstituted tobacco. The flight spans of lighter particles 56 are shorter; such particles descend onto the upper stretch or reach of a wide endless conveyor or apron 57 which is driven by one of its rollers 58, 59 to advance in the direction indicated by arrow 62. The picker roller 48 constitutes a simple but effective means for classifying the tobacco particles according to their size and/or weight.

The lighter particles 56 which accumulate on the upper reach of the apron 57 form a wide layer or sliver 61 which travels around the roller 59 and whose leading portion is showered into an elongated channel 63. Such particles form an elongated growing tobacco stream on the upper reach of a narrow tobacco stream forming conveyor belt 64 which is permeable to air. The upper reach of the belt 64 travels above the perforated top wall 67 of a stationary suction chamber 66 which extends lengthwise of the channel 63 and attracts the growing tobacco stream to the upper side of the upper reach of the belt 64. The stream is thereupon equalized (if necessary) and draped into a web of cigarette paper to form therewith a continuous cigarette rod which is severed so as to yield a file of plain cigarettes of unit length or multiple unit length.

If desired, the housing 5 may support a rapidly rotating cylindrical brush which is mounted above the channel 63 and whose bristles propel the particles 56 onto the upper reach of the belt 64.

The purpose of the spring 42 is to enable the sensor 37 to rapidly react to changing pressure of piled-up tobacco particles 2 in front of the second surface 36 of the barrier 28. The mechanical connection between the sensor 37 and the flap 26 of the duct 13 contributes to sensitivity, simplicity and ruggedness of the distributor. It has been found that a pivotable sensor, in cooperation with the spring 42 or analogous biasing means, is capable of regulating the cross-sectional area of the outlet 23 with a degree of precision which greatly enhances the homogeneousness and predictability of dimensions of the layer of tobacco particles which move into the range of the picker roller 48.

It is also within the purview of the invention to replace the pivotable flap 6 of the duct 13 with an elastically deformable wall portion which tends to assume a position in which the cross-sectional area of the outlet 23 is relatively large and is deformable by the sensor 37 and/or by suitable adjusting means to reduce the cross-sectional area when the pressure of piled-up tobacco particles upon the sensor increases.

The operation of the improved distributor is as follows:

The carding of the upper reach of the conveyor 3 draws from the magazine 1 a carpet 10 of tobacco particles 2 which may but need not have a constant thickness. The blades of the paddle wheel 6 effect some equalization of the removed tobacco carpet so that the carpet which reaches and travels around the roller 9 has a substantially constant thickness or height. The particles of the carpet 10 are expelled from the carding of the conveyor 3 by the pins of the rapidly rotating picker roller 11 which propels the particles into the inlet of the duct 13. As mentioned above, the photoelectric cell 16 monitors the height of the tobacco column 14 and controls the speed of the roller 8 and conveyor 3 (via connection 17) to insure that the height of such column remains substantially constant. This, in turn, insures that the density of the column 14 in the region of the outlet 23 of the duct 13 remains within a desirable optimum range. The speed of the roller 8 is increased if the level of the upper surface of the column 14 descends, and vice versa.

The carding 51 of the drum 18 removes a layer of tobacco particles 2 from the outlet 23 at a substantially constant rate which normally exceeds the rate at which the particles 2 can pass between the homogenizing surface 29 of the barrier 28 and the periphery of the drum 18. The grooves and raised portions of the surface 29 effect a highly desirable homogenization of the fibrous material which enters the space between the drum 18 and the barrier 28, and the thus homogenized layer is advanced into the range of pins on the rapidly rotating picker roller 48 which classifies the particles according to their size and/or weight.

The surplus of tobacco particles 2 which leave the outlet 23 of the duct 13 with the carding 51 of the drum 18 is intercepted by and piles up in front of the second surface 36 of the reciprocating barrier 28. As the quantity of the thus intercepted tobacco particles increases, the piled-up particles exert a progressively increasing pressure against the underside of the pivotable member 41 of the sensor 37. The just mentioned pile of particles 2 is confined between the periphery of the drum 18, the surface 36 of the barrier 28, the platens 15 of the housing 5 and the member 41. When the pressure (and hence the quantity) of this mass of tobacco particles reaches a predetermined value (which can be regulated by adjusting the bias and/or the position of the spring 42), the spring 42 yields and allows the bell crank lever 43 to pivot in a counterclockwise direction, as viewed in the drawing. The arm 46 of the lever 43 then causes the flap 26 to pivot in a counterclockwise direction so as to reduce the cross-sectional area of the outlet 23. This, in turn, results in a reduction of the rate at which tobacco particles 2 issue from the duct 13. The flap 26 can actually interrupt the evacuation of tobacco particles from the duct 13 for a relatively short interval of time; this enables the carding 51 of the drum 18 to remove some of the piled-up tobacco particles below the member 41 so that the pressure of such particles upon the member 41 decreases and the spring 42 is free to return the bell crank lever 43 to its normal or neutral position in which the flap 26 (which is biased clockwise by the particles in the outlet 23) allows tobacco to descend in the duct 13 and to advance into the path of movement of carding 51 on the drum 18. The fully automatic adjusting action of the sensor 37 renders it possible to regulate the quantity of tobacco particles 2 which issue from the duct 13 in such a way that the amount of tobacco particles which move between the drum 18 and the barrier 28 is substantially constant so that the surface 29 can perform a predictable homogenizing action.

An important advantage of the improved distributor, and particularly of the sensor 37 between the barrier 28 and the outlet 23 of the duct 13, is that the quantity of tobacco particles forming the aforediscussed pile below the member 41 of the sensor 37 is constant or fluctuates within an extremely narrow range. This enables the carding 51 to transport along the surface 29 a layer wherein the quantity of tobacco particles per unit length is sufficiently constant to allow the surface 29 to effect a desirable homogenization of the layer before the latter reaches the picker roller 48. The pile of tobacco particles 2 below the member 41 of the sensor 37 is held at a standstill, save for its lowermost stratum which is entrained by the carding 51, at least when the flap 26 is pivoted anticlockwise to reduce the rate of evacuation of tobacco particles from the duct 13 or to temporarily prevent any evacuation of tobacco particles via outlet 23. The just described mode of operation has been found to insure that the distributor produces surprisingly small quantities of short tobacco and tobacco dust.

The manner in which the layer 61 on the apron 57 is converted into a narrow tobacco stream forms no part of the invention. The illustrated parts 63, 64, 66 and 67 constitute but one form of means which can be used to convert a wide layer of tobacco shreds into a narrow tobacco stream. It is further clear that the improved distributor can be used with advantage in machines for the production of cigarillos or cigars.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. In an apparatus for producing and processing a homogenized layer of fibrous particles, particularly in a distributor for shredded tobacco, a combination comprising a source of fibrous particles, said source having an outlet and said outlet having a variable cross-sectional area; a conveyor having means for removing from said outlet a continuous layer of fibrous particles and for advancing said layer in a predetermined direction along a predetermined path wherein said layer has an exposed side; a barrier adjacent to said path and having a first surface in contact with the exposed side of said layer and a second surface adjacent to said first surface, extending substantially transversely of said path and facing counter to said direction so that at least some fibrous particles of said layer are intercepted by and pile up at said second surface; means for moving said barrier substantially transversely of said path whereby said first surface homogenizes that portion of said layer which is moved beyond said second surface; sensor means for monitoring the quantity of piled-up particles at said second surface; and adjusting means operatively connected with said sensor means and arranged to vary the cross-sectional area of said outlet in response to variations in the quantity of piled-up particles at said second surface.

2. A combination as defined in claim 1, wherein said source is a duct having a first end provided with said outlet and a second end provided with an inlet, and further comprising a magazine for a supply of fibrous particles and means for feeding particles from said magazine into the inlet of said duct.

3. A combination as defined in claim 1, wherein said conveyor is a rotary drum and said removing means comprises a carding at the periphery of said drum, said first surface having raised and recessed portions which homogenize said layer between said first surface and said drum in response to movement of said barrier transversely of said path.

4. A combination as defined in claim 3, further comprising means for rotating said drum about a substantially horizontal axis, said outlet being located at a level below said inlet and said sensor means and said barrier being located above said axis.

5. A combination as defined in claim 1, wherein said sensor means includes a member which monitors the pressure of piled-up particles at said second surface of said barrier.

6. A combination as defined in claim 1, wherein said barrier is elongated and said sensor means comprises an elongated member bearing against the piled-up particles immediately upstream of said second surface, said member extending transversely of said path alongside said barrier.

7. A combination as defined in claim 1, wherein said sensor means is pivotable about a predetermined axis and further comprising means for biasing said sensor means against the piled-up particles at said second surface of said barrier.

8. A combination as defined in claim 7, wherein said biasing means comprises a spring.

9. A combination as defined in claim 1, wherein the operative connection between said sensor means and said adjusting means is a mechanical connection.

10. A combination as defined in claim 1, wherein said source includes wall means and said adjusting means includes a portion of said wall means, said portion of said wall means being adjacent said outlet and being pivotable to thereby vary the cross-sectional area of said outlet, said sensor means including a lever pivotable about a predetermined axis and having a first arm abutting against the piled-up particles at said second surface of said barrier and a second arm forming part of said adjusting means and abutting against said pivotable wall portion.

* * * * *